United States Patent [19]

Yashiro et al.

[11] Patent Number: 4,566,409

[45] Date of Patent: Jan. 28, 1986

[54] TWO-CYCLE ENGINE

[76] Inventors: Yoshinobu Yashiro; Takeshi Ito, both of 2822 Nishikaizuka, Iwata-shi, Shizuoka-ken, Japan

[21] Appl. No.: 446,652

[22] Filed: Dec. 3, 1982

[30] Foreign Application Priority Data

Dec. 15, 1981 [JP] Japan ..... 56-201864

[51] Int. Cl.[4] ..... F02B 25/04

[52] U.S. Cl. ..... 123/65 PE

[58] Field of Search ..... 123/65 P, 65 PE, 65 PD, 123/65 A, 65 EM

[56] References Cited

U.S. PATENT DOCUMENTS

| | | | |
|---|---|---|---|
| 1,743,558 | 1/1930 | McCabe | 123/65 PE |
| 2,735,260 | 2/1956 | Laubender | 123/65 A |
| 3,545,354 | 3/1976 | Johnston | 123/65 P |
| 4,341,188 | 7/1982 | Nerstrom | 123/65 PE |

FOREIGN PATENT DOCUMENTS

| | | | |
|---|---|---|---|
| 529865 | 7/1954 | Belgium | 123/65 PD |
| 0081854 | 6/1983 | European Pat. Off. | 123/65 P |
| 1096677 | 1/1961 | Fed. Rep. of Germany | 123/65 P |
| 1110773 | 10/1955 | France . | |
| 0023842 | 9/1969 | Japan | 123/65 P |
| 389716 | 3/1933 | United Kingdom . | |

*Primary Examiner*—Craig R. Feinberg
*Assistant Examiner*—David A. Okonsky
*Attorney, Agent, or Firm*—Donald D. Mon

[57] ABSTRACT

It is an object of this invention to provide a two-cycle engine which enables the prevention of carbon in the exhaust port, and ensures a minimum reduction in the open area of the exhaust port for a long period of time. This is attained by including a groove or shoulder formed in at a least a portion of the wall of an exhaust passage immediately behind an exhaust port, and extending along the edge of an opening defining the exhaust port to disable carbon to adhere easily to the exhaust port, or prevent any thick layer of carbon from adhering to the exhaust port so that the carbon layer may have only a limited strength and be easily removed.

12 Claims, 41 Drawing Figures

FIG. 1
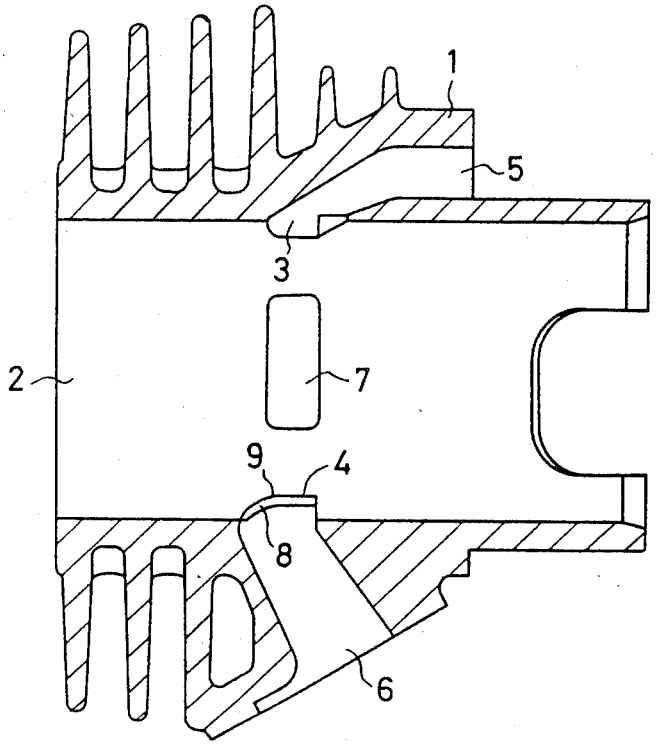
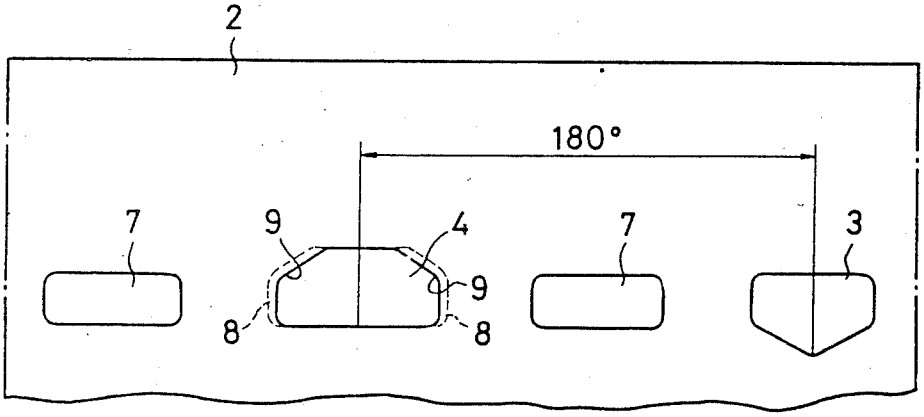
FIG. 2

FIG. 3
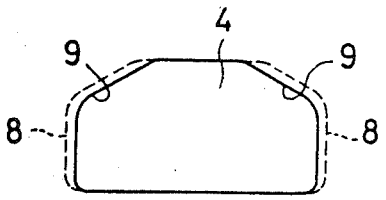
FIG. 4
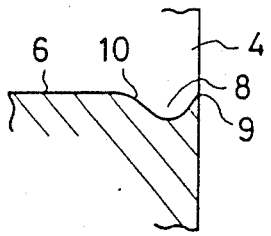
FIG. 5
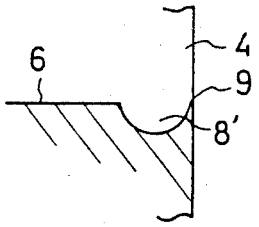
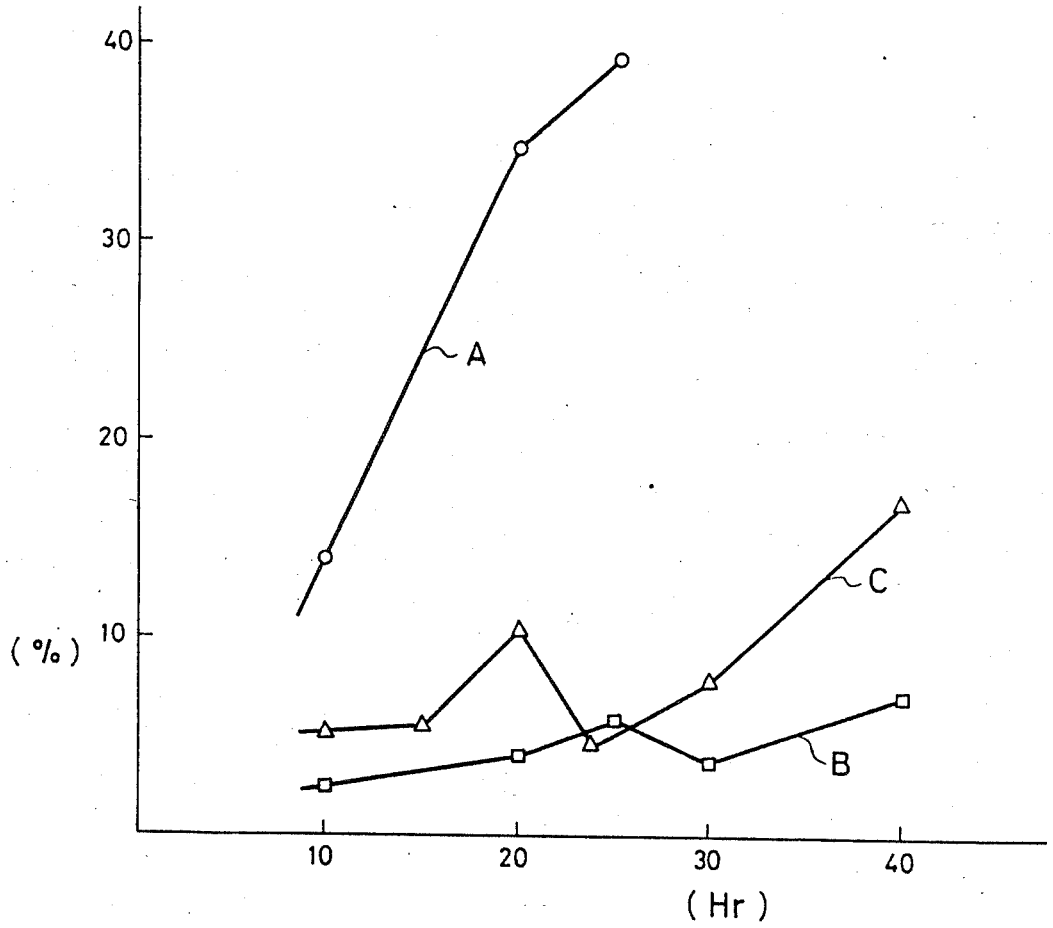
FIG. 6

FIG. 10
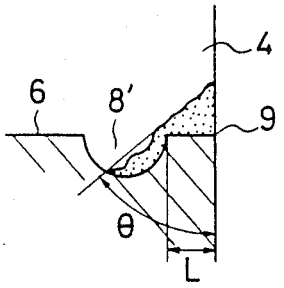
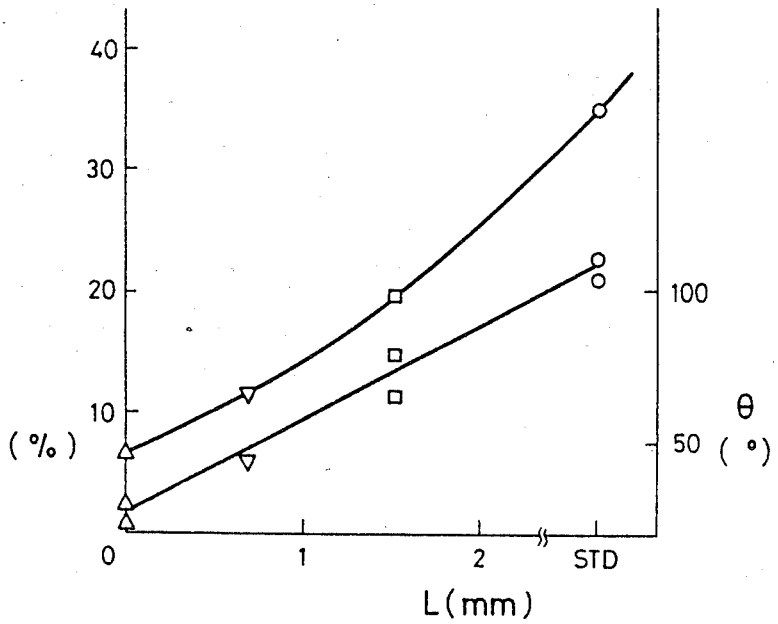
FIG. 11

FIG. 12
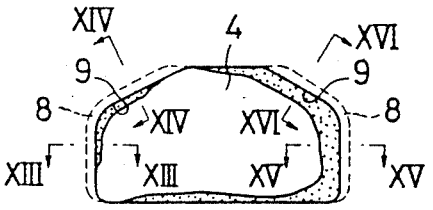
FIG. 13
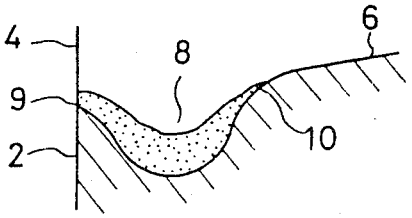
FIG. 15
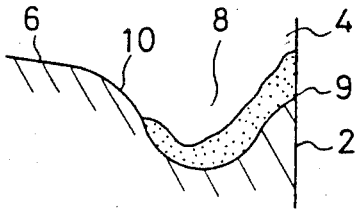
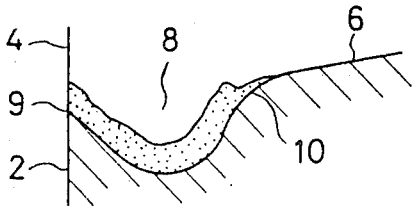
FIG. 14
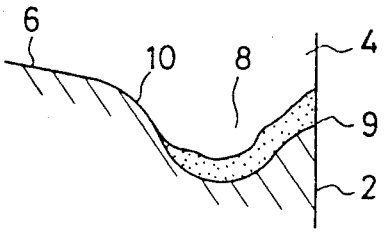
FIG. 16

FIG. 17
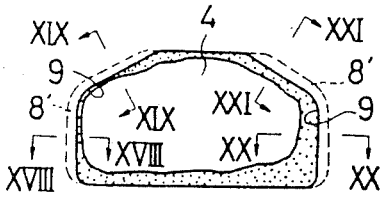
FIG. 18
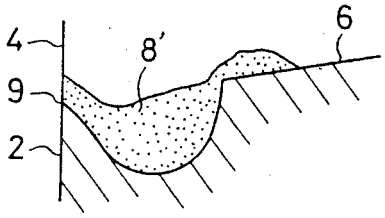
FIG. 20
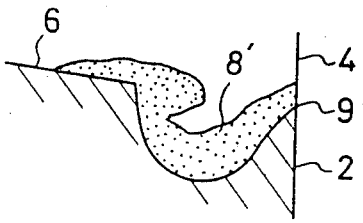
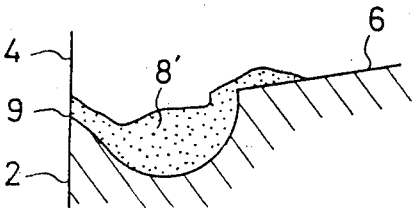
FIG. 19
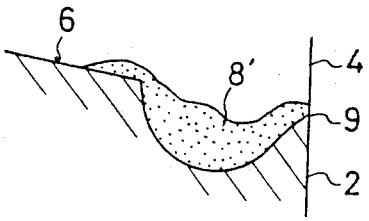
FIG. 21

TWO-CYCLE ENGINE

FIELD OF THE INVENTION

This invention relates to an exhaust port in a two-cycle engine.

BACKGROUND OF THE INVENTION

In a two-cycle engine, the opening and closing of intake, scavenging and exhaust ports formed in the inner surface of its cylinder are usually effected by the reciprocal motion of a piston. Fresh air is drawn into a crank chamber through the intake port upon upward movement of the piston, compressed upon downward movement of the piston, and flows into a combustion chamber through a scavenging passage and the scavenging port. Combustion gas is discharged from the combustion chamber through the exhaust port.

The fresh air contains engine oil, and this oil is also discharged through the combustion chamber and the exhaust port. A part of the oil adheres to the edge of the exhaust port facing the cylinder. As the exhaust port is exposed directly to the combustion gas having a high temperature and a high pressure, the oil is heated to form carbon which is likely to be deposited on the edge of the exhaust port. This carbon gradually grows with the lapse of the operating time, resulting in a drastic reduction in the open area of the exhaust port. As a result, the engine has a drastically lower exhaust efficiency, a lower output, and an adversely affected fuel comsumption, and is encountered with a number of other disadvantages, too.

Under these circumstances, it is an object of this invention to provide a two-cycle engine which enables the prevention of carbon in the exhaust port, and ensures a minimum reduction in the open area of the exhaust port for a long period of time.

BRIEF DESCRIPTION OF THE INVENTION

This object is attained by the invention which is characterized by including a groove or shoulder formed in at least a portion of the wall of an exhaust passage immediately behind an exhaust port, and extending along the edge of an opening defining the exhaust port to disable carbon to adhere easily to the exhaust port, or prevent any thick layer of carbon from adhering to the exhaust port so that the carbon layer may have only a limited strength and be easily removed.

BRIEF DESCRIPTION OF THE DRAWINGS

FIG. 1 is a longitudinal sectional view of a cylinder block,

FIG. 2 is an exploded view of the inner cylinder surface,

FIG. 3 is a front elevational view of an exhaust port in engine A,

FIG. 4 is a cross-sectional view of the exhaust port in engine A,

FIG. 5 is a cross-sectional view of the exhaust port in engine B,

FIG. 6 is a graph showing the rate of exhaust port blocking in relation to an increase of operating hours, FIGS. 7(*a*) to (*c*) illustrate the growth of carbon layer in a standard engine, FIGS. 8(*a*) to (*e*) illustrate the growth of a carbon layer in engine A, FIGS. 9(*a*) to (*e*) illustrate the growth of a carbon layer in engine B, FIG. 10 is a cross-sectional view showing the relationship between the groove position and the angle of the edge of a deposited carbon layer, FIG. 11 is a graph showing the relationship between the rate of exhaust port blocking and the angle of the edge of a deposited carbon layer in differently positioned grooves, FIG. 12 is a front elevational view of the exhaust port in engine A after 40 hours of operation, FIG. 13 is a sectional view taken along the line XIII—XIII of FIG. 12, FIG. 14 is a sectional view taken along the line XIV—XIV of FIG. 12, FIG. 15 is a sectional view taken along the line XV—XV of FIG. 12, FIG. 16 is a sectional view taken along the line XVI—XVI of FIG. 12, FIG. 17 is a front elevational view of the exhaust port in engine B after 40 hours of operation, FIG. 18 is a sectional view taken along the line XVIII—XVIII of FIG. 17, FIG. 19 is a sectional view taken along the line XIX—XIX of FIG. 17, FIG. 20 is a sectional view taken along the line XX—XX of FIG. 17, FIG. 21 is a sectional view taken along the line XXI—XXI of FIG. 17.

DETAILED DESCRIPTION OF THE INVENTION

Figure 7A:
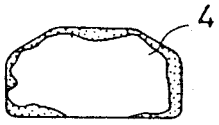

The invention will now be described by way of example with reference to FIGS. 1 to 26.

A cylinder block 1 defines a cylinder 2 therein. The cylinder 2 has an inner peripheral surface formed with an auxiliary scavenging port 3, and an exhaust port 4 which is diametrically opposite to the auxiliary scavenging port 3. The auxiliary scavenging port 3 and the exhaust port 4 are connected to an auxiliary scavenging passage 5 and an exhaust passage 6, respectively, which are formed in the cylinder block 1. The inner peripheral surface of the cylinder 2 is also formed with a pair of main scavenging ports 7 located between the auxiliary scavenging port 3 and the exhaust port 4. The main scavenging ports 7 are connected to a crank chamber not shown by scavenging passages (not shown) in the cylinder block 1.

The auxiliary scavenging port 3, the exhaust port 4 and the main scavenging ports 7 are opened and closed by a piston not shown.

The exhaust port 4 is generally rectangular along the circumference of the cylinder 2, and its top corners are beveled with the maximum height of the port in its mid-port, as shown in FIG. 2. The exhaust passage 6 is provided in its wall adjoining the exhaust port 4 with a pair of grooves 8 having an arcuate cross section and spaced apart from each other along the circumference of the cylinder 2. Each of the grooves 8 joins one of the lateral edges of the exhaust port 4 facing the interior of the cylinder 2 at an angle of about 45°, and therefore, each lateral edge of the exhaust port 4 has an acute corner 9. Each groove 8 is curved arcuately in cross section as shown at 10, and is contiguous along a smooth curve to the peripheral surface of the exhaust passage 6.

The grooves 8 and the corners 9 render it difficult for any oil in combustion gas to collect in the exhaust port 4, and prevent any adherence of such oil that may give rise to the deposition of carbon. Although a long time of continuous operation at a high load may unavoidably result in the deposition of carbon in the exhaust port 4 due to a high temperature prevailing around the exhaust port 4, the acute corners 9 provide only a very small area for the deposition of carbon, and permit only a thin layer of carbon to deposited therein. A thin layer of carbon is low in adhesion strength, and easily broken by the pressure of the combustion gas to be exhausted to be eventually scattered in the combustion gas. Although carbon is deposited in a layer of certain thickness with an increase of operating hours, therefore, it is thereafter broken and removed through the exhaust port 4. This feature, and the prevention of oil adherence ensure that a reduction in the open area of the exhaust port 4 and any change in the shape of its open area be kept at a minimum for a long period of time.

These advantages have been proven by the experiments conducted by the inventors of this invention. The results of these experiments will be described with reference to FIGS. 4 to 26.

Figure 7B:
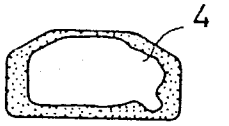
Figure 7C:
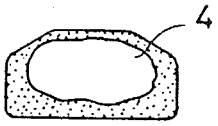
Figure 8A:
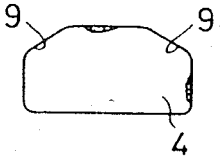
Figure 8B:
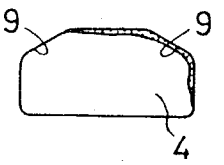
Figure 8C:
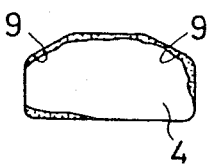
Figure 8D:
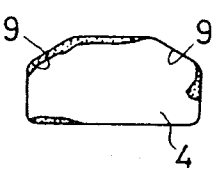
Figure 8E:
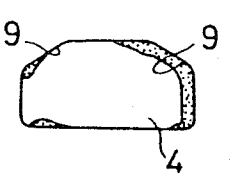
Figure 9A:
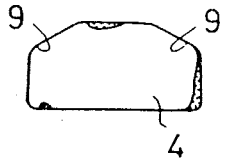
Figure 9B:
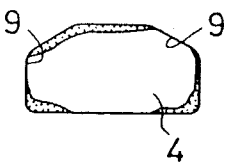
Figure 9C:
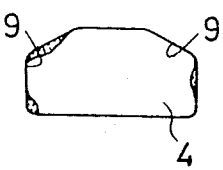
Figure 9D:
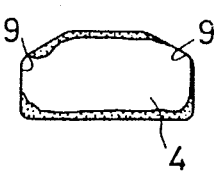
Figure 9E:
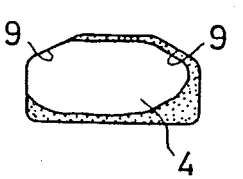

Experiments were first conducted to facilitate the understanding of this invention as will hereinafter be described. The state of blocking in the exhaust port 4 of a standard engine was examined with an increase of operating hours by 40 hours of operation of the engine in which the exhaust port 4 was directly connected to an exhaust passage 6. The results are shown by a curve A in FIG. 6. FIG. 6 shows the rate of port blocking calculated by the formula $S_1-S_2/S_1\times 100$ (%), in which $S_1$ stands for the open area of the exhaust port 4 prior to the operation, and $S_2$ stands for the open area of the exhaust port 4 after the operation. The state of carbon deposition observed after 10 hours of operation is shown at (a) in FIG. 7, the state after 20 hours of operation at (b) in FIG. 7, and the state after 25 hours of operation at (c) in FIG. 7. FIGS. 6 and 7 clearly indicate a continuous increase of carbon deposition and a drastic reduction in the open area of the exhaust port 4 in the standard engine with the lapse of time.

The effects of the grooves 8 were examined in an engine in which they were formed in the peripheral surface of the exhaust passage 6 connected to the exhaust port 4. The engine was an engine A of the type hereinbefore described, and was compared with an engine B provided with grooves 8' having no rounded edge 10 as shown in FIG. 5. Both of the engines were operated for 40 hours, and examined for the state of blocking of the exhaust port 4 with an increase of operating hours. The results are shown in FIG. 6, in which a curve B represents the rate of port blocking in the engine A, while a curve C indicates the rate of port blocking in the engine B. FIG. 8 shows at (a) to (e) the state of carbon deposition in the engine A after 10 hours, 20 hours, 25 hours, 30 hours and 40 hours of operation, while the state of carbon deposition in the engine B is likewise shown at (a) to (e) in FIG. 9. As is obvious from FIGS. 8 and 9, the grooves 8 and 8' ensure a drastic reduction of carbon deposition as compared with a standard engine, through they cannot completely avoid carbon deposition, and a reduction in the increasing proportion of the blocking rate. Thus, the combination of the grooves 8 or 8' and the acute corners 9 resists the adherence of oil in combustion gas to the exhaust port 4, and thereby prevents any substantial carbon deposition.

Even the engines A and B showed a gradually increasing rate of port blocking with an increase of operating hours, but the rates of port blocking in those engines showed a decrease upon reaching a certain level. In order to find out the reason for such a phenomenon, examination was made of the shape of a layer of carbon adhering to the exhaust port 4 in each of the engines A and B. The layer of carbon in both of the engines was found to be smaller in thickness than the layer of carbon deposited in the standard engine, and have a pointed edge facing the exhaust port 4. Therefore, the inventors tried to see experimentally how a layer of carbon would change in shape if the grooves 8 or 8' were spaced apart from the exhaust port 4 by a certain distance L as shown in FIG. 10. The results are shown in FIG. 11. FIG. 11 shows the rate of port blocking and the angle of the edge of a layer of carbon adhering to the exhaust port 4, as observed after 20 hours of engine operation. FIG. 11 indicates a reduction in the rate of port blocking and the angle $\theta$ with an approach of the grooves 8 or 8' to the exhaust port 4, i.e., the inner peripheral surface of the cylinder 2. It, therefore, follows that the formation of the exhaust port 4 with an acute edge enables a reduction in the angle $\theta$ of a layer of carbon adhering thereto, and that a generally pointed layer of carbon means a smaller carbon layer thickness and hence a reduction in its adhesion strength, so that a layer of carbon having a certain thickness may be easily broken by the pressure of combustion gas to be exhausted. Thus, the acute edges of the exhaust port 4 facilitate the removal of carbon if any, and ensure that a reduction in the open area of the exhaust port 4 and a change in the shape of its open area be kept at a minimum for a long period of time. As is obvious from the foregoing, it is preferable to provide the grooves 8 or 8' in a close proximity to the edges of the exhaust port 4 as possible.

The inventors also noticed a smaller quantity of carbon deposition in the engine A than in the engine B, and tried to find out the reason therefore. Both of the engines A and B were operated for 40 hours, and the exhaust port 4 of each engine was cut at four points, as shown in FIGS. 12 and 17, for examination as to the state of carbon deposition at each point. FIGS. 13 to 16 show the state of carbon deposition in the engine A, and FIGS. 18 to 21 show the state of carbon deposition in the engine B. These figures indicate that while the grooves 8' in the engine B were substantially filled with carbon after 40 hours of operation, the engine A showed a drastic reduction in the quantity of carbon deposition therein, though a certain quantity of carbon was observed. Although no definite reason for such differences is known as yet, the rounded edge 10 is believed to have a certain bearing on the improvement, since it constitutes the only difference in configuration between the grooves 8 and 8' in the two engines. In the engine A, each groove 8 has an outlet edge which is contiguous along a smooth curve to the peripheral surface of the exhaust passage 6, and which facilitates, therefore, the removal of any oil otherwise staying in the groove 8 by the pressure of combustion gas being exhausted. Thus, the rounded edge 10 is preferably provided at the outlet edge of each groove 8.

Figure 22:
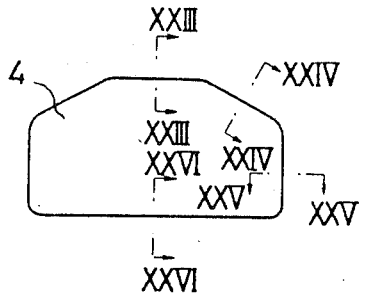
FIG. 22 is a front elevational view of the exhaust port in standard engine.
Figures 23, 24, 25, 26:
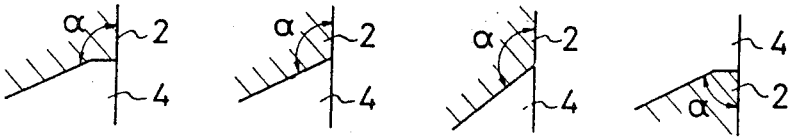
FIG. 23 is a sectional view taken along the line XXIII—XXIII of FIG. 22.
FIG. 24 is a sectional view taken along the line XXIV—XXIV of FIG. 22.
FIG. 25 is a sectional view taken along the line XXV—XXV of FIG. 22.
FIG. 26 is a sectional view taken along the line XXVI—XXVI of FIG. 22.

The grooves 8 are provided along both of the lateral edges of the exhaust port 4 for the reason which will hereinafter be set forth, and which is related to the effects of the grooves 8. As shown typically at (a) to (c) in FIG. 7, carbon is deposited in a larger quantity along the lateral edges of the exhaust port 4 in the standard engine than in any other portion thereof. The larger quantity of carbon deposition along the lateral edges of the exhaust port 4 and the fast growth of a carbon layer therefrom are apparently due to the fact that the angle between the peripheral surface of the exhaust port 4 contiguous to the exhaust passage 6 and the inner surface of the cylinder 2 is the largest along the lateral edges of the exhaust port 4, as shown in FIGS. 22 and 26 in which the exhaust port 4 is cut away diametrically of the cylinder 2. Accordingly, if at least the lateral edges of the exhaust port 4 are acutely pointed, it is believed that it is possible to prevent the initial deposition of carbon, and thereby keep the growth of a carbon layer at a minimum.

When the invention is worked, it is not always necessary to provide the exhaust port with an acutely pointed open edge, but it may be possible to space each groove apart from the exhaust port by a distance of, say, 1 to 2 mm and leave a narrow but flat edge for the exhaust port. This arrangement is also effective for a reduction in the area for carbon deposition, as opposed to the standard engine, as is obvious from FIG. 11.

Figure 27:
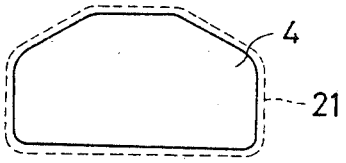
FIG. 27 is a front elevational view showing a modified groove.

Although in the embodiments of this invention as hereinabove described, the grooves are provided along the lateral edge of the exhaust port in mutually spaced apart relationship around the circumference of the cylinder, and only the lateral edges of the exhaust port are formed with acute corners, it is also possible to provide a continuous groove 21 along the circumference of the exhaust port 4, and form an acute edge along the entire periphery thereof, as shown by way of example in FIG. 27.

Figure 28:
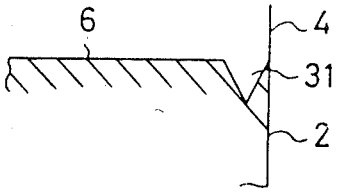
FIGS. 28 to 30 are cross-sectional views showing modified cross-sectional configurations of grooves.
Figure 29:
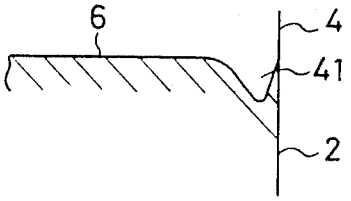
Figure 30:
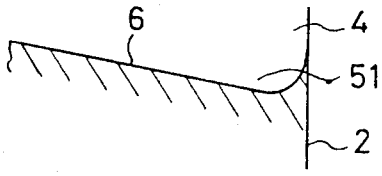
Figure 31:
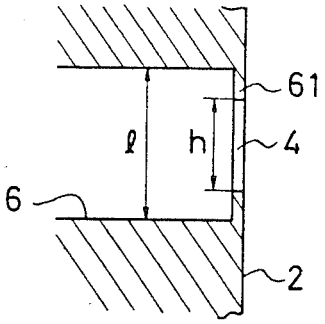
FIG. 31 is a longitudinal sectional view showing a further embodiment of this invention.

The cross-sectional configuration of the grooves is not limited to those hereinabove described with reference to the drawings, but may be of any other shape as shown by way of example at 31 in FIG. 28 or at 41 in FIG. 29, or at 51 in FIG. 30 in which the exhaust passage 6 has a tapered peripheral surface defining the groove 51.

Although according to the embodiments as hereinabove described, the grooves are formed in the wall of the exhaust passage, it is equally possible to provide a stepped shoulder 61 encircling the exhaust port 4, and defined by the enlargement of the diameter l of the exhaust passage 6 immediately downstream of the exhaust port 4 so that it may be larger than the height h of the exhaust port 4. This arrangement is as effective as the grooves in preventing adherence of carbon to the exhaust port, since the exhaust port 4 has a narrow edge not having any substantially flat area.

If the engine has a sleeve in its cylinder, it is, of course, necessary to provide acute corners in an exhaust port formed in the sleeve.

The cross-sectional configuration of the exhaust port is not limited to those hereinabove described with reference to the drawings, but must, of course, be selected so as to suit any desired engine performance.

The invention as hereinabove described in detail resides in a two-cycle engine comprising a cylinder having an inner peripheral surface provided with an exhaust port connected to an exhaust passage having a wall of which at least a portion is formed immediately behind the exhaust port with a groove or shoulder extending along the edge of the exhaust port. According to this engine, it is possible to prevent adherence of any oil giving rise to carbon deposition to the edge of the exhaust port when combustion gas containing such oil flows through the exhaust port. Although some carbon is deposited in the exhaust port with an increase of operating hours, the pointed or narrow edge of the exhaust port enables a reduction in the area for carbon deposition, and permits only a very thin carbon layer to be deposited. A thin layer of carbon is so low in adhesion strength that after it has grown into a certain thickness, it is broken by the pressure of combustion gas being exhausted, and removed from the exhaust port quickly. This feature, and the prevention of oil adherence ensure that a reduction in the open area of the exhaust port and a change in the shape of its open area be kept at a minimum for a long period of time to thereby prevent any reduction of engine performance. Since this invention does not require any change in the cross-sectional configuration of the exhaust port, it advantageously does not call for any substantial change in exhaust timing, or the like, nor is it likely to have any adverse effect on the engine performance.

We claim:

1. In a two-cycle internal combustion engine which includes a cylinder having a central axis, an internal cylindrical cylinder wall and an exhaust port, said exhaust port having a cross section substantially contant along its length and an internal peripheral wall which intersects and opens into said cylinder wall, forming a junction therewith, the said junction having a pair of lateral edge segments extending generally axially, and an upper and lower edge segment joining said lateral edge segments to form said junction substantially as a quadrilateral, the improvements comprising: a groove formed in said exhaust port wall extending to said junction, extending along at least both lateral edge segments and said upper edge segment, said junction at said last mentioned three segments lying in the cylindrical surface of the cylinder wall, said groove having a first sloping boundary wall on its side closest to said cylinder which lies at a dihedral angle on greater than 90 degree with said cylinder wall and forming an edge with said junction, the cross section of said exhaust port being equal to that at said junction edge.

2. Apparatus according to claim 1 in which said groove extends entirely around said exhaust port.

3. Apparatus according to claim 1 in which said first boundary wall directly intersects said cylinder wall.

4. Apparatus according to claim 3 in which said groove extends entirely around said exhaust port.

5. Apparatus according to claim 3 in which said dihedral angle is acute, and the junction substantially linear.

6. Apparatus according to claim 5 in which said groove extends entirely around said exhaust port.

7. Apparatus according to claim 1 in which said groove includes a second boundary wall which is on the opposite side of said first boundary wall from said cylinder.

8. Apparatus according to claim 7 in which said second boundary wall joins said exhaust port wall through a convex surface.

9. Apparatus according to claim 7 in which said second boundary wall is a shape generated by a substantially straight generator line.

10. Apparatus according to claim 7 in which both of said boundary walls are concavely shaped.

11. Apparatus according to claim 10 in which said first boundary wall directly intersects said cylinder wall.

12. Apparatus according to claim 11 in which said dihedral angle is acute, and the junction is substantially linear.

* * * * *